US005607908A

United States Patent [19]

Potini et al.

[11] Patent Number: 5,607,908

[45] Date of Patent: Mar. 4, 1997

[54] COMPOSITION FOR CLEANING CONTACT LENSES

[75] Inventors: Chimpiramma Potini, Methuen; Stanley J. Wrobel, Andover, both of Mass.

[73] Assignee: Wilmington Partners L.P.

[21] Appl. No.: 407,519

[22] Filed: Mar. 16, 1995

Related U.S. Application Data

[62] Division of Ser. No. 80,424, Jun. 18, 1993, Pat. No. 5,422, 029.

[51] Int. Cl.[6] ..... C11D 1/82; C11D 3/48

[52] U.S. Cl. ..... 510/115; 510/112; 510/466

[58] Field of Search ..... 252/174.15, 106, 252/173, 545, 554, 557; 510/112, 115, 466

[56] References Cited

U.S. PATENT DOCUMENTS

| | | | |
|---|---|---|---|
| 3,249,550 | 5/1966 | Metters | 252/161 |
| 4,048,122 | 9/1977 | Sibley et al. | 252/541 |
| 4,126,587 | 11/1978 | Sibley et al. | 252/541 |
| 4,354,952 | 10/1982 | Riedhammer et al. | 252/106 |
| 4,525,346 | 6/1985 | Stark | 424/80 |
| 4,613,380 | 9/1986 | Chen | 134/30 |
| 4,960,845 | 10/1990 | O'Lenick, Jr. | 528/25 |
| 5,070,168 | 12/1991 | O'Lenick, Jr. | 528/10 |
| 5,070,171 | 12/1991 | O'Lenick, Jr. | 528/33 |
| 5,073,619 | 12/1991 | O'Lenick, Jr. | 528/26 |
| 5,091,493 | 2/1992 | O'Lenick, Jr. | 528/30 |
| 5,093,452 | 3/1992 | O'Lenick, Jr. | 528/25 |
| 5,098,979 | 3/1992 | O'Lenick, Jr. | 528/15 |
| 5,166,297 | 11/1992 | O'Lenick, Jr. | 528/26 |
| 5,401,327 | 3/1995 | Ellis et al. . | |

FOREIGN PATENT DOCUMENTS

| | | |
|---|---|---|
| 2101735 | 3/1972 | France . |
| 8911878 | 12/1989 | WIPO . |

OTHER PUBLICATIONS

Database WPI, Section, Ch, Week 8247, Derwent Publications Ltd., London, GB, Class A97, AN 82–01144J & JP,A,57 168 218 (Oct. 1982).

*Primary Examiner*—Paul Lieberman
*Assistant Examiner*—Gregory R. Delcotto
*Attorney, Agent, or Firm*—Edward W. Black; Craig E. Larson

[57] ABSTRACT

A composition for cleaning contact lenses comprises a silicone surface active agent having cleaning activity for contact lens deposits. The silicone surface active agent has at least one side chain including a radical ionizable in aqueous solution.

11 Claims, No Drawings

COMPOSITION FOR CLEANING CONTACT LENSES

This is a divisional of application Ser. No. 08/080,424 filed on Jun. 18, 1993, now U.S. Pat. No. 5,422,029.

BACKGROUND OF THE INVENTION

This invention relates to a composition for cleaning contact lenses which comprises a silicone surface active agent having cleaning activity for contact lens deposits.

The tendency of contact lens materials to form deposits necessitates regular cleaning of the contact lenses. Deposits from the tear film include protein, lipid and mucin, and deposits from external sources include cosmetic deposits, such as from mascara or hair spray, or materials deposited when the lens is handled.

Surfactant contact lens cleaners, which employ a surface active agent having cleaning action, are used to remove lipid deposits, loosely bound protein deposits, and other deposits. Surfactant cleaners are used for hard and soft contact lenses. Hard lenses include polymethylmethacrylate lenses and rigid gas permeable (RGP) lenses formed of a silicon acrylate type or a fluorosilicon acrylate type polymer. Soft lenses include hydrophilic hydrogel lenses. Surfactant cleaners are generally used in conjunction with finger rubbing or other mechanical cleaning, followed by rinsing to remove the deposits.

A wide variety of surface active agents are known for use as a primary cleaning agent in contact lens cleaning compositions, including various anionic, cationic, nonionic or amphoteric surface active agents, and certain combinations thereof.

U.S. Pat. Nos. 4,048,122 and 4,126,587 (Sibley et al.) describe compositions for cleaning soft and silicone contact lenses which contain a polyoxyalkylene modified silicone resin and at least one fatty acid amide or nitrogen analog thereof. Additionally, compositions for cleaning machined lens blanks are described which do not employ any silicone resin and include a combination of the amides or nitrogen analogs as the primary cleaning agent. The described silicone resins are preferably block copolymers having the formula:

$$TSi(O(SiMe_2O)_x(C_nH_{2n}O)_yT'_3$$

wherein T is alkyl of from 1 to 3 carbon atoms, usually methyl, T' is alkyl of from 1 to 6 carbon atoms, usually 3 to 4 carbon atoms, n is an integer of from 2 to 30, and x and y are numbers within various ranges.

U.S. Pat. No. 4,613,380 (Chen) reports tests evaluating the effectiveness of various agents for removing lipid deposits from silicone elastomer contact lenses. A silicone glycol copolymer (Dow Corning® 190, a silicone polymer containing polyoxyethylene and/or polyoxypropylene side chains), designated in the patent as "Surfactant 1", was employed as a comparative example in tests for effectiveness at removing lipid deposits from the contact lenses.

It will be appreciated that the silicone resin in the Chen patent was reported as not particularly effective as a primary cleaning agent for contact lens deposits. Additionally, the compositions described in the Sibley et al. patents which include the described silicone resin require the inclusion of the amide surfactant as a primary cleaning agent.

SUMMARY OF THE INVENTION

In a first aspect, this invention provides an aqueous composition for cleaning contact lenses which comprises a silicone surface active agent having cleaning activity for contact lens deposits. The silicone surface active agent has at least one side chain including a radical ionizable in aqueous solution.

In other aspects, the invention relates to compositions for cleaning contact lenses which comprise the silicone surface active agent and an antimicrobial agent, and compositions for cleaning and wetting contact lenses which comprise the silicone surface active agent.

Additionally, the invention relates to methods employing the compositions.

DETAILED DESCRIPTION OF THE INVENTION

The cleaning composition of the invention is an aqueous composition which comprises a silicone surface active agent having cleaning action for contact lens deposits. The silicone surface active agent is a silicone polymer having at least one side chain including a radical ionizable in aqueous solution.

Representative silicone surface active agents are represented by Formula (I):

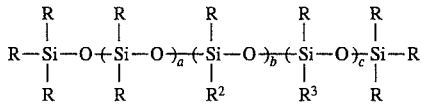

(I)

wherein:

each R is independently selected from the group consisting of $C_1$–$C_{11}$ alkyl and phenyl, preferably methyl;

each $R^2$ is independently a radical having the formula $$—R^4—O—(EO)_x—(PO)_y—(EO)_z—H;$$

each $R^3$ is independently a radical having the formula $$—R^4—O—(EO)_x—(PO)_y—(EO)_z—Z;$$

each $R^4$ is independently an alkylene radical having 1 to 6 carbon atoms;

each EO is the ethyleneoxide radical —($C_2H_4O$)—, preferably —($CH_2CH_2O$)—;

each PO is the propyleneoxide radical —($C_3H_6O$)—, preferably —($CH_2CH(CH_3)O$)—;

each Z is independently a radical ionizable in aqueous solution;

a is 0 or an integer of at least 1, preferably 0 to 200;

b is 0 or an integer of at least 1, preferably 0 to 200;

c is an integer of at least 1, preferably 1 to 200; and each of x, y and z is independently 0 or an integer of at least 1, preferably 0 to 20.

The compositions provide desired cleaning activity for a wide variety of contact lens deposits. In contrast with the compositions containing the silicone resins described in the aforementioned U.S. Pat. Nos. 4,613,380, 4,048,122 and 4,126,587, the present compositions may include the described silicone surface active agent as the primary cleaning agent, i.e., the compositions of the invention do not require another surface active cleaning agent such as the amide surface active agent required in the compositions of U.S. Pat. Nos. 4,048,122 and 4,126,587.

Additionally, the silicone surface active agents contribute to the ability of compositions to wet surfaces of contact lenses treated with the compositions. More specifically, it appears that when lenses are treated with the compositions, the hydrophobic silicone portion of these polymers may loosely associate with the lens surface, whereby the pendant side chain extends from the lens surface to enhance wettability of the lens surface.

These agents are also relatively nonirritating to the eye, and the invention also relates to compositions which are sufficiently nonirritating that a contact lens treated with the composition can be inserted directly on the eye. For example, the composition can be used for both cleaning and the subsequent rinsing of a contact lens to remove debris, or for cleaning and wetting a contact lens, wherein the contact lens exposed to the composition can be inserted directly in the eye.

The silicone surface active agent is a surface active agent having cleaning activity composed of a silicone backbone having one or more pendant side chains including the ionizable radical. Preferred agents include dimethylpolysiloxanes wherein at least one methyl group attached to silicon is replaced with the side chain containing the ionizable radical, such as the $R^3$ side chain and the optional $R^2$ side chain in Formula (I).

As illustrated in Formula (I), the $R^3$ side chains include a functional Z radical which is ionizable in aqueous solution, i.e., the Z radical includes an anionic functional group, a cationic functional group, or an amphoteric functional group. These functional ionizable groups render the silicone agent anionic, cationic or amphoteric, depending on the specific functional Z group.

The silicone surface active agents employed in the compositions are known or can be prepared by methods known to persons skilled in the art, and many of the agents are commercially available. Silicone surface active agents contemplated for the compositions include the following: the silicone phosphobetaines described in U.S. Pat. No. 5,091,493 (O'Lenick, Jr. et al.); the silicone phosphate amines described in U.S. Pat. No. 5,093,452 (O'Lenick, Jr.); the ether amine silicone polymers described in U.S. Pat. No. 5,070,168 (O'Lenick, Jr.); the sulfonated silicone polymers described in U.S. Pat. No. 4,960,845 (O'Lenick, Jr.); the silicone polymers described in U.S. Pat. No. 5,073,619 (O'Lenick, Jr.); the phosphated silicone polymers described in U.S. Pat. No. 5,070,171 ((O'Lenick, Jr.); and the silicone ester quaternary polymers described in U.S. Pat. No. 5,166,297 (O'Lenick, Jr.).

A preferred class of silicone surface active agents includes surface active agents which have a ionizable Z radical containing a sulfonate radical or a sulfosuccinate radical. Illustrative Z radicals $$-CO-CH_2-\underset{\underset{SO_3^-M^+}{|}}{CH}-COO^-M^+,$$

wherein in the above formulae, each M is independently selected from the group consisting of H, Na, K, Li and $NH_4$. Dimethylpolysiloxane polymers containing a pendant side chain having a sulfonate or sulfosuccinate radical are available under the tradenames Silube WS-100 and Silube SS-154-100 from Siltech, Inc., Norcross, Ga., U.S.A.

Another preferred class of silicone surface active agents include surface active agents having an ionizable Z radical containing a phosphate radical. Especially preferred are phosphobetaines which include a Z radical of the formula:

$$-\underset{\underset{(O^-M^+)_f}{|}}{P(O)}\leftarrow O-CH_2-CHOH-CH_2-R^6)_e$$

wherein $R^6$ is a quaternary ammonium radical, e is 1 or 2, f is 0 or 1, and the sum of e and f is 2; and M is selected from the group consisting of H, Na, K, Li and $NH_4$. Dimethylpolysiloxanes containing a pendant side chain with a phosphobetaine radical are available under the tradename Silicone Phosphobetaine from Siltech, Inc.

Other preferred silicone surface active agents include silicone surface active agents containing a Z radical of the formula:

$$-O-CH_2-CHOH-CH_2-\overset{\overset{CH_3}{|}}{\underset{\underset{CH_3}{|}}{N^+}}-CH_2-COO^-M^+$$

wherein M is selected from the group consisting of H, Na, K, Li and $NH_4$, such as the dimethylpolysiloxane substituted with propyleneglycol betaine available under the tradename Abil B 9950 from Goldschmidt Chemical Corp., Hopewell, Va., U.S.A; and silicone agents containing a Z radical of the formula:

$$-N(H)_q(CH_2CH_2COO^-M^+)_r$$

wherein q is 1 or 2, r is 0 or 1, and the sum of q and r is 2; and M is selected from the group consisting of H, Na, K, Li and $NH_4$, such as the dimethylpolysiloxanes available under the tradename Siltech Amphoteric from Siltech, Inc.

In addition to the silicone surface active agent, other surface active agents may optionally be employed in the compositions. A wide variety of surface active cleaners are known in the art, including anionic, cationic, nonionic and amphoteric surface active agents.

Representative anionic surface active agents include sulfated and sulfonated surface active agents, and physiologically acceptable salts thereof, which provide good cleaning activity for lipids, proteins, and other contact lens deposits. Examples include sodium lauryl sulfate, sodium laureth sulfate (sodium salt of sulfated ethoxylated lauryl alcohol), ammonium laureth sulfate (ammonium salt of sulfated ethoxylated lauryl alcohol), sodium trideceth sulfate (sodium salt of sulfated ethoxylated tridecyl alcohol), sodium dodecylbenzene sulfonate, disodium lauryl or laureth sulfosuccinate (disodium salt of a lauryl or ethoxylated lauryl alcohol half ester of sulfosuccinic acid), disodium oleamido sulfosuccinates, and dioctyl sodium sulfosuccinate (sodium salt of the diester of a 2-ethylhexyl alcohol and sulfosuccinic acid).

Nonionic surface active agents having good cleaning activity include certain polyoxyethylene, polyoxypropylene block copolymer (poloxamer) surface active agents, including various surface active agents available under the tradename Pluronic from BASF Corp., e.g., Pluronic P104 or L64. (In contrast with the high-HLB PEO-containing materials, the poloxamers which may be employed as a primary cleaning agent in the compositions of this invention have an HLB value less than 18, generally about 12 to about 18.) Other representative nonionic surface active agents include: ethoxylated alkyl phenols, such as various surface active agents available under the tradenames Triton (Union Carbide, Tarrytown, N.Y., U.S.A.) and Igepal (Rhone-Poulenc, Cranbury, N.J., U.S.A.); polysorbates such as polysorbate 20, including the polysorbate surface active agents available under the tradename Tween (ICI Americas, Inc., Wilmington, Del., U.S.A.); and alkyl glucosides and polyglucosides such as products available under the tradename Plantaren (Henkel Corp., Hoboken, N.J., U.S.A.).

The compositions may include a cationic surface active agent. Representative cationic surface active agents include triquaternary phosphate esters, such as various cationic surface active agents available from Mona Industries, Inc., Patterson, N.J., U.S.A. under the tradename Monaquat.

Additionally, the compositions may include an amphoteric surface active agent. Amphoteric surface active agents include fatty acid amide betaines, such as the cocoamidoalkyl betaines available under the tradename Tego-Betain (Goldschmidt Chemical Corp., Hopewell, Va., U.S.A.). Other amphoterics include imidazoline derivatives such as cocoamphopropionates available under the tradename Miranol (Rhone-Poulenc), and N-alkylamino acids such as lauramino propionic acid available under the tradename Mirataine (Rhone-Poulenc).

The surface active agents having cleaning activity for contact lens deposits, including the silicone cleaning agents, may be employed at about 0.001 to about 5 weight percent of the composition, preferably at about 0.005 to about 2 weight percent, with about 0.01 to about 0.1 weight percent being especially preferred.

As mentioned, the silicone polymers contribute to the ability of the composition to wet surfaces of contact lenses treated therewith. If desired, compositions intended for cleaning and wetting contact lenses may include as necessary a supplemental wetting agent. Representative wetting agents include: cellulosic materials such as cationic cellulosic polymers, hydroxypropyl methylcellulose, hydroxyethyl cellulose and methylcellulose; polyvinyl alcohol; polyvinyl pyrrolidone; and silicone polymers containing a pendant alkyleneoxy side chain (particularly, polymers wherein the side chain does not include an ionizable radical). These latter silicone polymers are preferred in that they are especially compatible with the silicone polymers employed as the primary cleaning agent. Additionally, these latter silicone polymers are useful for alleviating eye irritation potential of the compositions. A preferred material is Dow Corning® 193 (Dow Corning, Midland, Mich., U.S.A.).

Additionally, for compositions intended for application to the eye, such as the cleaning and wetting compositions, the compositions may include a polyethyleneoxy (PEO) containing material (in addition to any silicone polymer which contains PEO in the pendant side chain), especially a PEO-containing material having a hydrophile-lipophile balance (HLB) of at least about 18. These high-HLB PEO-containing materials are useful for further reducing the irritation potential of the surface active agent or other components in the compositions, and in some cases the PEO-containing material may contribute to the wetting ability of the composition. Representative PEO-containing materials include homopolymers of polyethylene glycol or polyethyleneoxide having the high HLB value, and certain poloxamers such as materials commercially available from BASF under the tradenames Pluronic F108 and Pluronic F127. Other preferred PEO-containing materials include ethoxylated glucose derivatives, such as the ethoxylated products available under the tradename Glucam (Amerchol Corp., Edison, N.J., U.S.A.), and high HLB ethoxylated nonionic ethers of sorbitol or glycerol, such as products available under the tradename Ethosperse, including sorbeth-20 supplied as Ethosperse SL-20 and glycereth-26 supplied as Ethosperse G-26 (Lonza Inc., Fair Lawn, N.J., U.S.A.).

When present, the PEO-containing materials and/or the above-described wetting agents may be used in a wide range of concentrations, generally about 0.1 to about 10 weight percent.

The compositions include as necessary buffering agents for buffering or adjusting pH of the composition, and/or tonicity adjusting agents for adjusting the tonicity of the composition. Representative buffering agents include: alkali metal salts such as potassium or sodium carbonates, acetates, borates, phosphates, citrates and hydroxides; and weak acids such as acetic, boric and phosphoric acids. Representative tonicity adjusting agents include: sodium and potassium chloride, and those materials listed as buffering agents. The tonicity agents may be employed in an amount effective to adjust the osmotic value of the final composition to a desired value. Generally, the buffering agents and/or tonicity adjusting agents may be included up to about 10 weight percent.

According to preferred embodiments, an antimicrobial agent is included in the composition in an antimicrobially effective amount, i.e., an amount which is effective to at least inhibit growth of microorganisms in the composition. Preferably, the composition can be used to disinfect a contact lens treated therewith. Various antimicrobial agents are known in the art as useful in contact lens solutions, including: chlorhexidine (1,1'-hexamethylene-bis[5-(p-chlorophenyl)biguanide]) or water soluble salts thereof, such as chlorhexidine gluconate; polyhexamethylene biguanide (PHMB, a polymer of hexamethylene biguanide, also referred to as polyaminopropyl biguanide) or water-soluble salts thereof, such as the polyhexamethylene biguanide hydrochloride available under the trade name Cosmocil CQ (ICI Americas Inc.); benzalkonium chloride; and polymeric quaternary ammonium salts. When present, the antimicrobial agent may be included at 0.00001 to about 5 weight percent, depending on the specific agent.

The compositions may further include a sequestering agent (or chelating agent) which can be present up to about 2.0 weight percent. Examples of preferred sequestering agents include ethylenediaminetetraacetic acid (EDTA) and its salts, with the disodium salt (disodium edetate) being especially preferred.

The compositions are useful for cleaning hard and soft contact lenses. Hard lenses include polymethylmethacrylate lenses and rigid gas permeable (RGP) lenses formed of a silicon or a fluorosilicon polymer. Soft contact lenses include hydrophilic hydrogel lenses.

A contact lens is cleaned by exposing the lens to the cleaning composition, preferably by immersing the lens in the composition, followed by agitation, such as by rubbing the composition on the lens surface. The lens is then rinsed to remove the composition along with contaminants.

For wetting contact lens, contact lenses are exposed to the compositions, either by employing the composition to rinse the lenses or by soaking the lenses in the composition. The lens can then be inserted directly in the eye.

The compositions listed in the following tables can be prepared by the following general procedure.

The compositions can be prepared by adding the individual components to water. A representative method follows. The salts and wetting agents, such as sodium chloride, potassium chloride, disodium edetate, cellulosic components, and/or polyvinyl alcohol (PVA), are added to premeasured, heated water with mixing. This first composition is allowed to cool, filtered, and sterilized. The sodium phosphate, potassium phosphate, PEO-containing material, the silicone polymer, the surface active agents and/or glycerin are added to premeasured water with mixing and then sterilized and filtered. The antimicrobial agents are added to the remaining amount of premeasured water, and the three compositions are combined with mixing.

TABLE I

| Component | EX 1 | EX 2 | EX 3 | EX 4 |
|---|---|---|---|---|
| sodium chloride | 0.70 | 0.70 | 0.70 | 0.70 |
| potassium chloride | 0.040 | 0.040 | 0.040 | 0.040 |
| disodium edetate | 0.050 | 0.050 | 0.050 | 0.050 |
| hydroxypropyl methylcellulose | 0.60 | 0.60 | 0.60 | 0.60 |
| sodium phosphate | 0.55 | 0.55 | 0.55 | 0.55 |
| potassium phosphate | 0.11 | 0.11 | 0.11 | 0.11 |
| polyethylene glycol (Polyox-WSR 301, 1%, Union Carbide) | 0.10 | 0.10 | 0.10 | 0.10 |
| glycerin | 0.050 | 0.050 | 0.050 | 0.050 |
| alkoxylate silicone polymer (193, Dow Corning) | 0.015 | 0.015 | 0.015 | 0.015 |
| amphoteric polysiloxane (Siltech-Ampho, Siltech) | 0.030 | — | — | — |
| sulfosuccinate polysiloxane (Silube SS-154-00, Siltech) | — | 0.030 | — | |
| silicone betaine (Abil B 9950, Goldschmidt) | — | — | 0.030 | — |
| phosphobetaine polysiloxane (Siltech Phosphobetaine) | — | — | — | 0.030 |
| PHMB (Cosmocil CQ, 20%, ICI Americas) | 0.003 | 0.003 | 0.003 | 0.003 |
| Deionized Water (q.s. to) | 100 | 100 | 100 | 100 |

TABLE 2

| Component | EX 5 | EX 6 | EX 7 | EX 8 |
|---|---|---|---|---|
| sodium chloride | 0.70 | 0.70 | 0.70 | 0.70 |
| potassium chloride | 0.040 | 0.040 | 0.040 | 0.040 |
| disodium edetate | 0.050 | 0.050 | 0.050 | 0.050 |
| hydroxypropyl methylcellulose | 0.60 | 0.60 | 0.60 | 0.55 |
| sodium phosphate | 0.55 | 0.55 | 0.55 | 0.55 |
| potassium phosphate | 0.11 | 0.11 | 0.11 | 0.11 |
| polyethylene glycol (1%, Polyox-WSR 301) | 0.10 | 0.10 | 0.10 | — |
| methyl gluceth-20 (Glucam E-20, Amerchol) | — | — | — | 0.10 |
| PVA | 1.50 | — | — | — |
| glycerin | 0.050 | 0.050 | 0.050 | — |
| alkoxylated silicone polymer (193, Dow Corning) | 0.015 | 0.015 | 0.015 | 0.015 |
| Siltech-Ampho | 0.020 | — | — | 0.020 |
| Silube SS-154-00 | — | 0.020 | — | — |
| Abil B 9950 | — | — | 0.020 | — |
| PHMB (20%) | 0.003 | 0.003 | 0.003 | 0.025 |
| chlorhexidine gluconate (20%) | — | — | — | 0.0165 |
| Deionized Water (q.s. to) | 100 | 100 | 100 | 100 |
| pH | 7.3 | 7.3 | 7.3 | 7.3 |
| Viscosity (cp 25° C.) | 45.9 | 41.4 | 45.1 | 34.6 |
| Osmolality | 364 | 369 | 366 | 366 |

The compositions of Examples 1 to 8 were tested for cleaning efficacy by the following procedure. The surfaces of fluorosilicone RGP contact lenses were contaminated with Vaseline® Intensive Care lotion. In separate tests, the surfaces of RGP contact lenses were contaminated with lanolin. The contaminated lenses were rubbed with the subject composition, rinsed with water, and inspected visually. Each of the compositions provided excellent cleaning of the contact lenses.

Additionally, the compositions of Examples 1 to 4 (Table 1) were tested according to the following procedure on twenty wearers of RGP contact lenses. First, each subject's lenses were soaked in a composition for at least five minutes, and then the soaked lenses were inserted directly (i.e., without rinsing) onto the subject's eye. The amount of irritation occurring within the first 20–30 seconds after insertion was rated by the subjects using the following scale:

0=no irritation

1

2=very mild irritation

3

4=mild irritation

5

6=moderate irritation

7

8=severe irritation

Additionally, five drops of each composition were then instilled directly into both eyes of each subject (one drop every 5 minutes). Again, the amount of irritation occurring within the first 20–30 minutes after instillation of each drop was rated using the above scale.

The entire procedure was repeated on separate days until each subject had tested each composition. The average rating at insertion and following instillation of each drop is listed in Table 4. The data demonstrate that the compositions were substantially nonirritating to the eye.

TABLE 4

| | Average Irritation Rating | | | | | | |
|---|---|---|---|---|---|---|---|
| | | Drop Number | | | | | Overall |
| Comp | Insertion | 1 | 2 | 3 | 4 | 5 | Average |
| EX 1 | 0.9 | 1.5 | 1.2 | 1.4 | 1.3 | 1.5 | 1.26 |
| EX 2 | 0.8 | 0.6 | 0.8 | 1.2 | 1.3 | 1.4 | 1.02 |
| EX 3 | 0.9 | 0.8 | 0.9 | 0.9 | 0.8 | 0.8 | 0.82 |
| EX 4 | 0.8 | 0.8 | 0.7 | 0.9 | 1.0 | 1.0 | 0.83 |

Although certain preferred embodiments have been described, it is understood that the invention is not limited thereto and modifications and variations would be evident to a person of ordinary skill in the art.

We claim:

1. A method of cleaning a contact lens comprising exposing a contact lens to an aqueous composition comprising a silicone surface active agent having cleaning activity for contact lens deposits and represented by the formula:

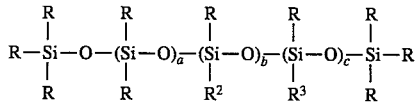

wherein:

each R is independently selected from the group consisting of $C_1$–$C_{11}$ alkyl and phenyl;

each $R^2$ is independently a radical having the formula $$—R^4—O—(EO)_x—(PO)_y—(EO)_z—H;$$

each $R^3$ is independently a radical having the formula $$—R^4—O—(EO)_x—(PO)_y—(EO)_z—Z;$$

each $R^4$ is independently an alkylene radical having 1 to 6 carbon atoms;

each EO is an ethyleneoxide radical;

each PO is a propyleneoxide radical;

each Z is independently a radical ionizable in aqueous solution;

a is 0 or an integer of at least 1;

b is 0 or an integer of at least 1;

c is an integer of at least 1; and each of x, y and z is independently 0 or an integer of at least 1.

2. The method of claim 1 wherein said aqueous composition includes at least one of: a wetting agent, an antimicrobial agent, a buffering agent, and a tonicity agent.

3. The method of claim 1 wherein at least one side chain of the silicone polymer contains an ionizable radical selected from at least one of the following: a sulfonate radical, a sulfosuccinate radical, a phosphate radical, and a phosphobetaine radical.

4. The method of claim 1 wherein Z represents a sulfonate radical.

5. The method of claim 1 wherein Z represents a sulfosuccinate radical.

6. The method of claim 1 wherein Z represents a phosphate radical.

7. The method of claim 1 wherein Z represents a phosphobetaine radical.

8. A method of cleaning and disinfecting a contact lens comprising exposing a contact lens to an aqueous composition comprising an antimicrobial agent and silicone surface active agent having cleaning activity for contact lens deposits and represented by the formula:

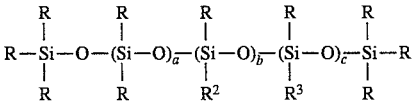

wherein:

each R is independently selected from the group consisting of $C_1$–$C_{11}$ alkyl and phenyl;

each $R^2$ is independently a radical having the formula $$—R^4—O—(EO)_x—(PO)_y—(EO)_z—H;$$

each $R^3$ is independently a radical having the formula $$—R^4—O—(EO)_x—(PO)_y—(EO)_z—Z;$$

each $R^4$ is independently an alkylene radical having 1 to 6 carbon atoms;

each EO is an ethyleneoxide radical;

each PO is a propyleneoxide radical;

each Z is independently a radical ionizable in aqueous solution;

a is 0 or an integer of at least 1;

b is 0 or an integer of at least 1;

c is an integer of at least 1; and each of x, y and z is independently 0 or an integer of at least 1.

9. A method of cleaning and wetting a contact lens comprising rubbing a contact lens with an aqueous composition comprising a silicone surface active agent having cleaning activity for contact lens deposits and represented by the formula:

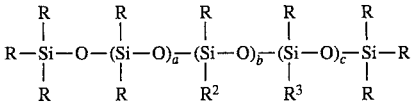

wherein:

each R is independently selected from the group consisting of $C_1$–$C_{11}$ alkyl and phenyl;

each $R^2$ is independently a radical having the formula $$—R^4—O—(EO)_x—(PO)_y—(EO)_z—H;$$

each $R^3$ is independently a radical having the formula $$—R^4—O—(EO)_x—(PO)_y—(EO)_z—Z;$$

each $R^4$ is independently an alkylene radical having 1 to 6 carbon atoms;

each EO is an ethyleneoxide radical;

each PO is a propyleneoxide radical;

each Z is independently a radical ionizable in aqueous solution;

a is 0 or an integer of at least 1;

b is 0 or an integer of at least 1;

c is an integer of at least 1; and each of x, y and z is independently 0 or an integer of at least 1; and subsequently exposing the contact lens to the aqueous composition to wet a surface of the lens.

10. The method of claim 9, wherein the contact lens is immediately inserted into the eye after the step of rubbing the lens with the aqueous composition.

11. A method of cleaning a contact lens comprising exposing a contact lens to an aqueous composition comprising a silicone surface active agent having cleaning activity for contact lens deposits and represented by the formula:

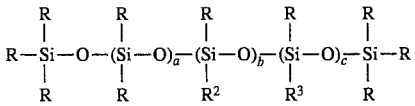

wherein:

each R is independently selected from the group consisting of $C_1$–$C_{11}$ alkyl and phenyl;

each $R^2$ is independently a radical having the formula $$—R^4—O—(EO)_x—(PO)_y—(EO)_z—H;$$

each $R^3$ is independently a radical having the formula $$—R^4—O—(EO)_x—(PO)_y—(EO)_z—Z;$$

each $R^4$ is independently an alkylene radical having 1 to 6 carbon atoms;

each EO is an ethyleneoxide radical;

each PO is a propyleneoxide radical;

each Z is independently a radical ionizable in aqueous solution and is selected from: a sulfonate radical, a sulfosuccinate radical, a phosphate radical, and a phosphobetaine radical;

a is 0 or an integer of at least 1;

b is 0 or an integer of at least 1;

c is an integer of at least 1; and each of x, y and z is independently 0 or an integer of at least 1.

* * * * *